US009840840B2

(12) United States Patent
Plikat et al.

(10) Patent No.: US 9,840,840 B2
(45) Date of Patent: Dec. 12, 2017

(54) PARTITION SYSTEM

(71) Applicant: Herman Miller, Inc., Zeeland, MI (US)

(72) Inventors: Claudia Plikat, Berlin (DE); Johann Burkhard Schmitz, Berlin (DE); Carola Eva Marianne Zwick, Berlin (DE); Roland Rolf Otto Zwick, Berlin (DE)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 15/074,073

(22) Filed: Mar. 18, 2016

(65) Prior Publication Data

US 2016/0201321 A1 Jul. 14, 2016

Related U.S. Application Data

(63) Continuation of application No. 14/579,770, filed on Dec. 22, 2014, now Pat. No. 9,303,401, which is a continuation of application No. 13/394,423, filed as application No. PCT/DE2010/001059 on Sep. 9, 2010, now Pat. No. 9,010,034.

(30) Foreign Application Priority Data

Sep. 9, 2009 (DE) ..... 10 2009 040 699
Aug. 23, 2010 (DE) ..... 10 2010 035 173

(51) Int. Cl.

| | |
|---|---|
| ***E04C 2/30*** | (2006.01) |
| ***E04B 2/74*** | (2006.01) |
| ***E04B 2/00*** | (2006.01) |
| ***E04C 2/52*** | (2006.01) |

(52) U.S. Cl.
CPC ..... *E04B 2/7405* (2013.01); *E04C 2/30* (2013.01); *E04C 2/46* (2013.01); *E04C 2/52* (2013.01); *E04B 2002/7483* (2013.01); *E04B 2002/7488* (2013.01); *E04B 2103/04* (2013.01)

(58) Field of Classification Search
CPC ..... E04B 2/7405; E04B 2103/04; E04B 2002/7483; E04B 2002/7488; E04C 2/52; E04C 2/46; E04C 2/30
See application file for complete search history.

(56) References Cited

U.S. PATENT DOCUMENTS

| | | | | |
|---|---|---|---|---|
| 332,256 | A | 12/1885 | Keepler | |
| 1,937,981 | A | 12/1933 | Rosenthal | |
| D129,924 | S * | 10/1941 | Lowther | D6/675.1 |

(Continued)

FOREIGN PATENT DOCUMENTS

| | | |
|---|---|---|
| DE | 202004008322 | 7/2004 |
| EP | 0030510 | 6/1981 |

(Continued)

OTHER PUBLICATIONS

English translation of European Office Action for Application No. 10 773 544.1-1604 dated Jul. 26, 2016 (6 pages).

*Primary Examiner* — Beth Stephan
(74) *Attorney, Agent, or Firm* — Michael Best & Friedrich LLP

(57) ABSTRACT

A partition system includes a plurality of wall elements merging one into another, wherein at least one wall element is designed as a stepped element, and wherein at least one wall element is designed as a corner element.

22 Claims, 15 Drawing Sheets

(56) References Cited

U.S. PATENT DOCUMENTS

| | | | | | |
|---|---|---|---|---|---|
| 2,814,080 | A | * | 11/1957 | Tvorik | E04F 13/042 52/417 |
| D223,838 | S | * | 6/1972 | Valic | D6/650 |
| 3,907,068 | A | | 9/1975 | Ulerich | |
| D248,912 | S | * | 8/1978 | Canfield | D6/643.1 |
| D257,100 | S | * | 9/1980 | Berman | D6/699 |
| 4,224,769 | A | | 9/1980 | Ball et al. | |
| D262,505 | S | * | 1/1982 | Buchanan | D6/699 |
| D267,340 | S | * | 12/1982 | Watanabe | D24/177 |
| D327,385 | S | * | 6/1992 | Allen | D6/678.2 |
| 5,794,391 | A | | 8/1998 | Howard | |
| D412,625 | S | | 8/1999 | Montague, III et al. | |
| D420,523 | S | * | 2/2000 | Stumpf | D6/372 |
| 6,047,750 | A | | 4/2000 | Jensen | |
| 6,052,958 | A | | 4/2000 | Miedema et al. | |
| 6,151,852 | A | | 11/2000 | Linn et al. | |
| D435,181 | S | * | 12/2000 | Brozak, Jr. | D6/680 |
| 6,276,102 | B1 | | 8/2001 | Shipman et al. | |
| 6,349,507 | B1 | | 2/2002 | Muellerleile | |
| 6,434,890 | B1 | | 8/2002 | Konnerth | |
| 6,536,358 | B1 | | 3/2003 | Fears | |
| D494,776 | S | * | 8/2004 | Metz | D6/680.2 |
| 6,805,249 | B1 | | 10/2004 | Houle | |
| 6,929,131 | B1 | | 8/2005 | Landi | |
| 7,249,741 | B1 | * | 7/2007 | Larson | A47B 13/02 108/150 |
| D571,577 | S | * | 6/2008 | Van Es | D6/678.2 |
| 7,581,650 | B1 | | 9/2009 | Shen | |
| 2001/0013209 | A1 | | 8/2001 | Waalkes et al. | |
| 2003/0024189 | A1 | | 2/2003 | Hughes et al. | |
| 2003/0154686 | A1 | * | 8/2003 | Platt | E04B 9/061 52/506.05 |
| 2004/0003556 | A1 | | 1/2004 | Zerbst | |
| 2005/0144883 | A1 | | 7/2005 | Hopson et al. | |
| 2005/0193668 | A1 | * | 9/2005 | Hamilton | E04F 13/042 52/371 |
| 2006/0225372 | A1 | | 10/2006 | Gonzalez | |
| 2007/0277467 | A1 | * | 12/2007 | Platt | B21D 47/01 52/506.07 |
| 2008/0078728 | A1 | | 4/2008 | Hodge | |
| 2008/0212311 | A1 | | 9/2008 | Peterson | |
| 2008/0232098 | A1 | | 9/2008 | Nelson et al. | |
| 2008/0245018 | A1 | * | 10/2008 | Miller | E04B 9/061 52/506.07 |
| 2008/0245026 | A1 | * | 10/2008 | Hamilton | E04F 13/04 52/698 |
| 2009/0031653 | A1 | | 2/2009 | Nash | |
| 2009/0141486 | A1 | | 6/2009 | Migli | |
| 2010/0257807 | A1 | * | 10/2010 | Raheel | E04B 9/245 52/506.07 |

FOREIGN PATENT DOCUMENTS

| | | |
|---|---|---|
| FR | 2918089 | 1/2009 |
| NL | 1018730 | 2/2003 |
| NL | 1033119 | 6/2008 |

* cited by examiner

PARTITION SYSTEM

RELATED APPLICATIONS

This application is a continuation of U.S. Ser. No. 14/579,770, filed Dec. 22, 2014, which is a continuation of U.S. Ser. No. 13/394,423, filed Mar. 6, 2012, now U.S. Pat. No. 9,010,034, issued Apr. 21, 2015, which was a 371 National Stage application of PCT Application Serial No. PCT/DE2010/001059, filed Sep. 9, 2010, which claims priority to German Serial No. 102009040699.9 filed Sep. 9, 2009 and German Serial No. 102010035173.3 filed Aug. 23, 2010, the entire disclosure of which is hereby incorporated by reference.

FIELD OF THE INVENTION

This application relates to a partition system, which includes a plurality of wall elements merging one into another, and to a partition system, which includes at least one wall element.

BACKGROUND

NL 1 033 119 discloses a room divider which consists of pillars which are each composed of two components.

BRIEF SUMMARY

The embodiments in this application provide a simple partition system which can be adapted individually in terms of its profile to the requirements and has an additional value beyond just providing a partition.

The partition system includes a plurality of wall elements merging one into another, wherein at least one wall element is designed as a stepped element, and wherein at least one wall element is designed as a corner element, wherein the stepped element has two contact surfaces oriented parallel to each other, wherein the stepped element has two visible surfaces oriented parallel to each other, wherein the first visible surface runs continuously from a lower edge to an upper edge of the stepped element, wherein the second visible surface is designed as an offset visible surface which has at least two visible subsurfaces which merge one into the other via at least one step which forms a supporting surface, wherein the corner element has two contact surfaces which are oriented at an angle of 20° to 160° to each other, wherein the corner element has two visible surfaces, wherein the first visible surface runs continuously from a lower edge to an upper edge of the corner element, wherein the second visible surface has at least one step which forms a supporting surface, and at least one visible subsurface, wherein the contact surfaces of adjacent wall elements are congruent, and wherein adjacent wall elements face each other by means of the contact surfaces thereof and are connected to each in particular other by at least one connecting means. A partition system of this type is suitable for delimiting individual work places in a large-capacity office continuously and without interruption on a plurality of sides and at the same time for providing supporting surfaces and depositing surfaces which are usable every day. In particular, work places can be delimited in an L-shaped manner and U-shaped manner, seen in top view, by the partition system. A large-capacity office can be subdivided individually and without a large outlay on construction, wherein the planning is facilitated by the simple geometry of the individual wall elements.

The partition system may be supplemented by at least one wall element which is designed as a junction element, wherein the junction element has three perpendicular contact surfaces. By means of a T component of this type or connecting point of this type, junctions permitting in particular the connection of the partitions of adjacent work islands can be realized in the partition profile.

The partition system may be supplemented by at least one wall element which is designed as an intersection element, wherein the intersection element has four perpendicular contact surfaces which are aligned in particular in pairs parallel to one another. With an intersection component of this type, partition guides which are even more individual can be realized, and it is possible in particular to avoid the partitions running parallel to one another, and therefore the space taken up by the partition system is reduced to a minimum.

To further optimize the space taken up and to further individualize the partition system, provision is made for the latter to be supplemented by at least one wall element which is designed as a change-over element, wherein the change-over element has two perpendicular contact surfaces, wherein the change-over element has two visible surfaces which each comprise at least one step with a supporting surface, and wherein the two contact surfaces are oriented in a mirror-rotated manner or mirror-symmetrical manner to each other with respect to a vertical mirror axis. It is possible, with the interconnection of a change-over element of this type, to change over from a stepped element in a first orientation to a stepped element in a second orientation, wherein the stepped element in the second orientation is rotated through 180° about a vertical axis in relation to the stepped element in the first orientation.

The partition system may include at least one wall element, wherein the wall element has at least two contact surfaces, wherein the wall element has at least two visible surfaces, wherein at least one of the visible surfaces is designed as an offset visible surface which has four visible subsurfaces which merge one into another via three steps. A partition system of this type is suitable for delimiting individual work places in a large-capacity office continuously and without interruption on a plurality of sides and at the same time of providing, by means of the steps, surfaces which are usable every day. In particular, work places can be delimited in an L-shaped manner and U-shaped manner, as seen in top view, by the partition system. A large-capacity office can be subdivided individually and without a large outlay on construction, wherein the planning is facilitated by the simple geometry of the individual wall elements.

Provision is made for at least one of the visible surfaces to have a continuous profile from a lower edge to an upper edge of the wall element, and, furthermore, provision is made for the steps in particular to each form a supporting surface, and, finally, provision is made in particular for the partition system to be equipped in particular with at least one connecting means, wherein adjacent wall elements are connected to each other in particular by at least one connecting means. Continuous and step-free visible surfaces are suitable in particular for the space-saving delimitation of work islands from aisles. The formation of each step with a supporting surface gives rise to a multiplicity of useful surfaces which, by means of the terrace-shaped graduation thereof, are usable for a very wide variety of requirements. By adjacent wall elements being connected, the arrangement of the wall elements can be stabilized with the minimal outlay.

Furthermore, the lower three steps may be formed at a bench height of approximately 45 cm to 55 cm, at a work surface height of approximately 65 cm to 72 cm and at a "kitchen" counter height of approximately 84 cm to 90 cm and to form a fourth step, at which the uppermost visible subsurface merges into a top surface, at a counter height of approximately 104 cm to 110 cm. Provision is made here to dimension the wall element in the first, lowermost section in particular with a width of approximately 34 cm to 38 cm, in the second section with a width of approximately 23 cm to 28 cm, in the third section with a width of approximately 13 cm to 19 cm, and in the fourth, uppermost section with a width of approximately 3 cm to 8 cm, wherein the individual widths are each measured horizontally in one of the contact planes or contact surfaces of the wall element. Such a dimensioning results in a stable and at the same time space-saving wall element, since the basic surface thereof is fully available to the user via the individual steps, and the structure thereof provides improved options for use in relation to a flat surface.

The partition system additionally includes at least one furniture element which is designed in particular as a seat and/or in particular as a table and/or in particular as a work table and/or in particular as a counter, wherein the furniture element is supported in particular on at least one wall element, and wherein the furniture element is connected to the wall element in particular in a form-fitting manner. By means of a combination of wall elements and furniture elements matched to the wall elements, many of the items of furniture required in an office room can be integrated into the partition system. Construction space can be saved owing to the fact that, for example in the case of a table top, a wall element is used at least on one side as a table support. Furthermore, the partition system is additionally stabilized by the direct connection of office furniture, and the furniture elements of the partition system can be produced cost-effectively, since parts of the furniture elements are formed by the wall elements which are already present.

A top surface is provided on the wall element, said top surface connecting the contact surfaces of the wall element and being aligned in particular parallel to a bottom surface of the wall element, wherein, in a stepped element, in particular the first visible surface of the stepped element and the upper visible subsurface of the stepped element are connected by the top surface, and wherein, in a corner element, provision is made in particular to connect the first visible surface of the corner element and the upper visible subsurface of the corner element by means of the top surfaces. By means of the top surface, the stepped element or the corner element has a storage option, for example for files, which is accessible from both sides of the partition.

The geometrical shape of each wall element may be defined by a core composed of a solid material. By means of such a formation of the individual wall elements to be in one piece in the core, the wall elements do not have to be assembled from individual components in a laborious and time-consuming manner. Furthermore, such a construction of a wall element permits a retrospective, individual configuration of the wall element by the application of a coating. A finished wall element of this type then consists of a core defining the geometrical shape and of a shell by means of which the wall element can be matched in the composition of the surface thereof and/or the appearance thereof to the individual requirements.

Plastic and in particular foam and in particular rigid foam may be used as the solid material of which the core is composed, wherein the solid material is formed in particular from expandable polystyrene (EPS) which has in particular a volume weight of approximately 20 kg/m$^3$ to 70 kg/m$^3$ and in particular approximately 40 kg/m$^3$, or wherein the solid material is formed in particular from expanded polypropylene (EPP) which has in particular a volume weight of approximately 20 kg/m$^3$ to 70 kg/m$^3$ and in particular approximately 40 kg/m$^3$. By this means, in comparison to wall elements produced, for example, from wooden panels, the individual wall elements have a low weight which simplifies in particular transportation in the building. Furthermore, by means of the use of materials of this type, the wall elements have heat-insulating and sound-absorbing properties and therefore permit effective protection of the delimited work place from drafts and sound. In the case of expanded materials, the wall elements can simply be adapted to various requirements, such as, for example, stability and loadbearing capacity, by changing the volume weight.

Furthermore, at least one of the steps, which are arranged between the visible subsurfaces, of one of the wall elements may be provided with a groove which is open vertically upward with respect to the supporting surface of the step and is additionally in particular open laterally with respect to at least one of the contact surfaces. This makes it possible for documents or electronic devices, for example mobile telephones, to be securely deposited on the work place such that they are secured against dropping off. If adjacent wall elements have laterally open grooves, it is possible for the wall elements also to be correspondingly used in a transition region from wall element to wall element. Furthermore, the grooves are suitable for the stable insertion of flat screens and/or raised parts of the partition and/or mirrors and/or for the clipping on of illuminating means or holders.

The wall element may be equipped with a first cable duct which is formed by an offset in the bottom surface of the wall element, wherein the offset is also open with respect to the contact surfaces of the wall element. Furthermore, the wall element may be equipped in particular with at least one second cable duct which is formed by a bore, wherein the second cable duct extends from the top surface of the wall element or one of the supporting surfaces of the wall element or one of the grooves of the wall element into the first cable duct or to the bottom surface. By means of the first cable duct, a wall element formed in such a manner permits simple laying of supply lines wherever wall elements are used. By means of the second cable duct, it is possible, for example, for current to be supplied in a targeted manner to individual work places.

The partition system may be supplemented by a floor rail system on which the wall elements are guided, wherein the floor rail system comprises a plurality of guide elements fastened on the floor, wherein the guide element has in particular at least one web which is perpendicular in the room and which bears in particular against the wall element or which penetrates in particular into the wall element. By this means, and in particular by adhesively bonding and/or screwing the guide elements to the floor of a room which is to be furnished, the positioning of the wall elements can be precisely predetermined and kept permanently. The individual wall elements can then simply be inserted into the fitted floor rail system without further installation steps.

The connecting means may be designed as a clamp, wherein the clamp comprises two pins running parallel to each other, wherein the wall element has, in particular in the bottom surface and/or in particular in the grooves, at least one bore which runs vertically in the wall element and into which one end of the clamp can be inserted, wherein the bores of adjacent wall elements and the clamp are coordinated with one another in such a manner that the clamp holds the adjacent wall elements together such that the contact surfaces thereof are in contact. It is thereby possible using simple means to connect adjacent wall elements by means of a plug-in system.

Furthermore, the clamp may be provided with a support and an adjustable foot, wherein the two pins are fastened to the support and point in a first direction, and wherein the adjustable foot is arranged centrally between the pins on the support and points in a second direction, wherein the second direction is opposed to the first direction. A clamp of this type can be used as a furniture foot which supports two adjacent wall elements in the region of the contact surfaces thereof bearing against each other in the floor. In particular, provision is made for the adjustable foot to be of height-adjustable design. It is thereby possible to compensate for unevennesses of the floor on which the wall elements are standing.

Finally, the step of each wall element or for the lowermost step of each wall element may be arranged at a height of at least 40 cm and in particular 60 cm and for an overall height of each wall element to be in particular at least 100 cm. By this means, the lowermost step can be used at a height of 40 cm to approximately 50 cm as a seat option. If the step is at a higher position, the step may be a support for a tabletop.

Further details of the invention are described in the drawing with reference to exemplary embodiments which are illustrated schematically.

DETAILED DESCRIPTION OF THE DRAWINGS AND THE PRESENTLY PREFERRED EMBODIMENTS

Figure 4:
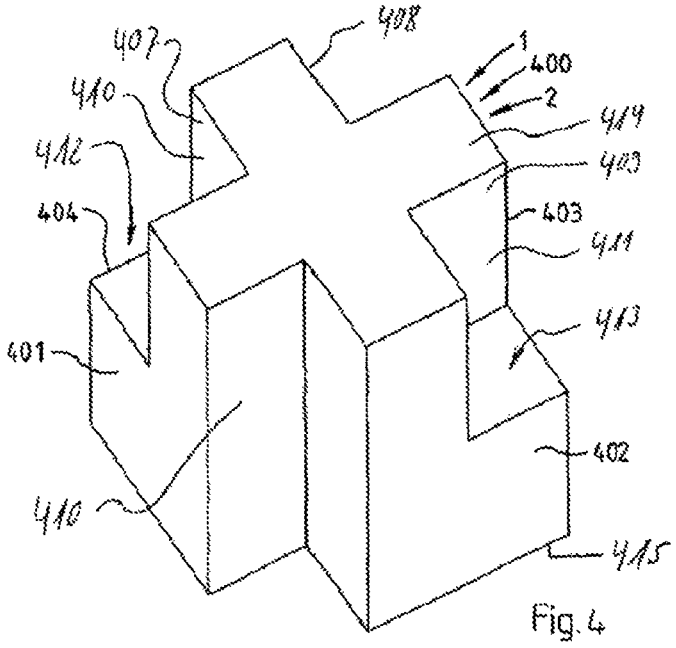
Figure 5:
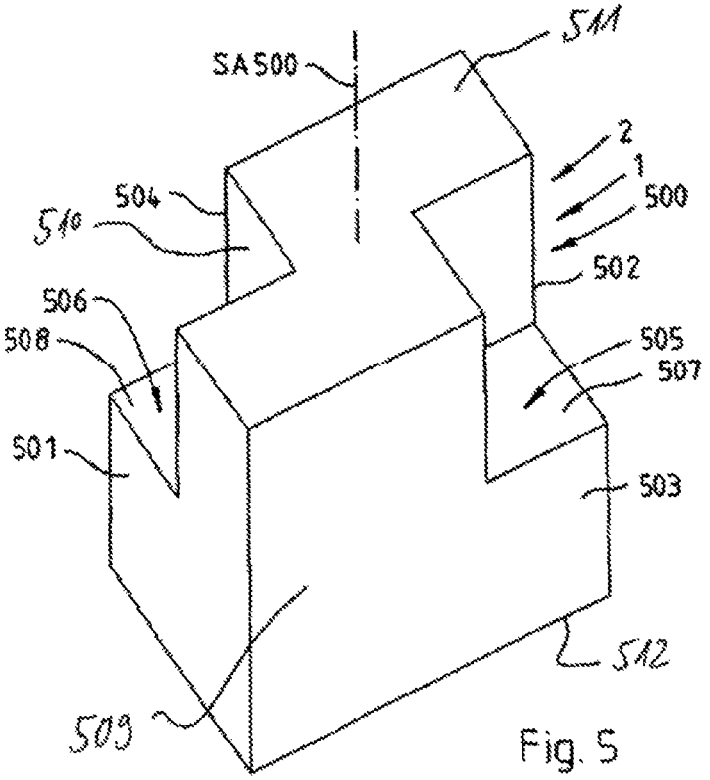
Figure 6:
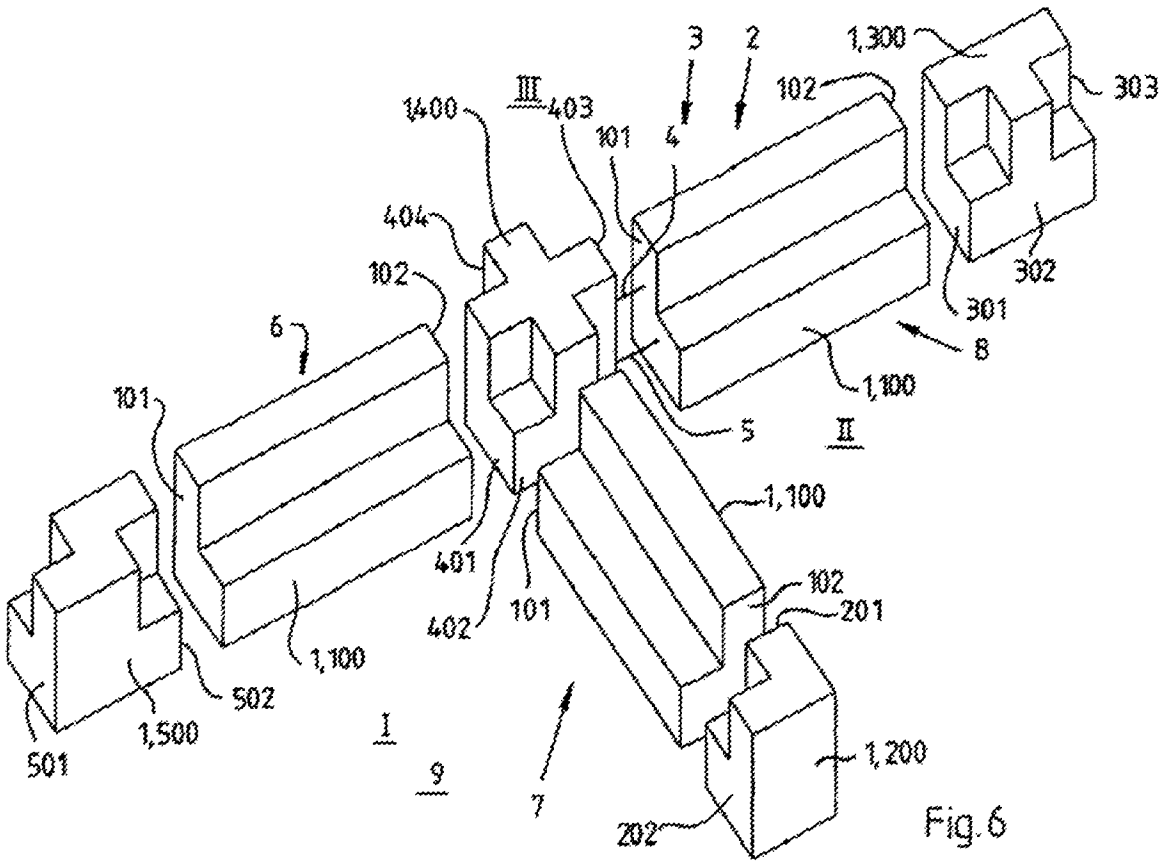
FIG. 6 shows a partition which is composed of wall elements of the first partition system.

FIGS. 1 to 5 show wall elements 1 of a first partition system 2 in a schematic, perspective view, and FIG. 6 shows a partition 3 composed of wall elements 1 of the first partition system 2, in a schematic, perspective exploded view.

Figure 1:
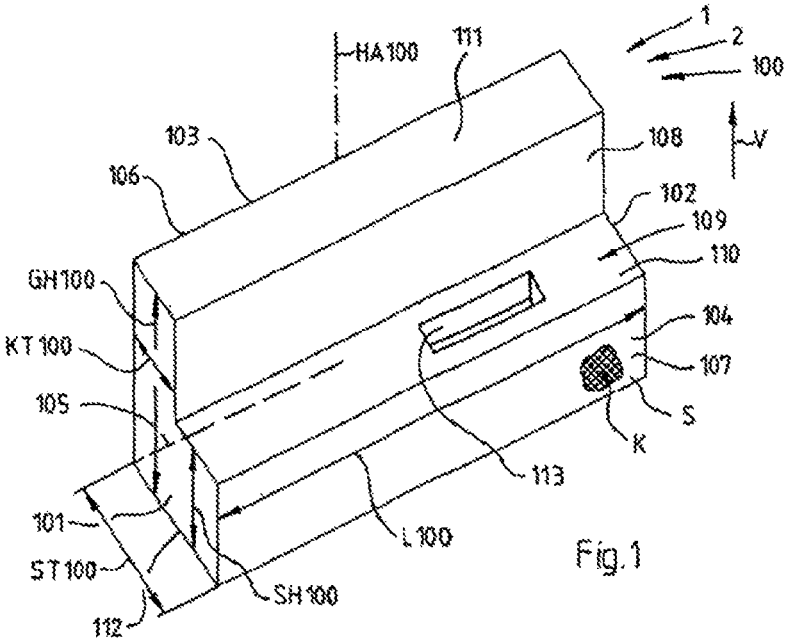
FIGS. 1 to 5 show wall elements of a first partition system.

The wall element 1, which is shown in FIG. 1, of the first partition system 2 is designed as a stepped element 100. The stepped element 100 has two contact surfaces 101 and 102 oriented approximately parallel to each other. Furthermore, stepped element 100 has two visible surfaces 103 and 104 oriented approximately parallel to each other. In this case, the first visible surface 103 runs continuously from a lower edge 105 to an upper edge 106 of the stepped element 100. The second visible surface 104 is designed as an offset visible surface 104 and consists of two visible subsurfaces 107 and 108. The latter merge one into the other via a step 109 which forms a supporting surface 110. The first visible surface 103 of the stepped element 100 and the upper visible subsurface 108 of the stepped element 100 are connected by a top surface 111. The latter runs parallel to a bottom surface 112 of the stepped element 100. The stepped element 100 has a length L100, an overall height GH100, a base height SH100, a base depth ST100 and a head depth KT100. As an alternative embodiment, FIG. 1 shows a groove 113 which is recessed into the supporting surface 110 of the step 109 and is open upward in the direction of a vertical V and forms a trough. According to a further variant embodiment (not illustrated), the groove extends over the entire length L100 of the stepped element 100 and is also open toward the contact surfaces 101 and 102.

Figure 2:
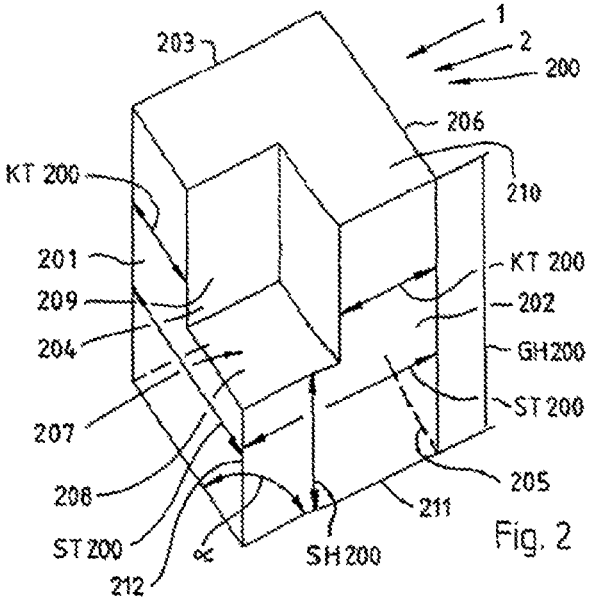

The wall element 1, which is shown in FIG. 2, of the first partition system 2 is designed as a corner element 200. The corner element 200 has two contact surfaces 201 and 202 oriented perpendicularly in the room. Said contact surfaces are at an angle $\alpha$ of 90° to each other. The corner element 200 furthermore has two visible surfaces 203 and 204. In this case, the first visible surface 203 is designed as an angled or bent visible surface which runs between the contact surfaces 201 and 202 from an L-shaped lower edge 205 to an L-shaped upper edge 206 of the corner element 200. The second visible surface 204 is likewise designed as an angled or bent visible surface and comprises a step 207 which has a supporting surface 208, and an upper visible subsurface 209. The first visible surface 203 of the corner element 200 and the upper visible subsurface 209 of the corner element 200 are connected by a top surface 210. The latter runs parallel to a bottom surface 211 of the corner element 200. The corner element 200 has an overall height GH200, a base height SH200, a base depth ST200 and a head depth KT200. In the case of the corner element 200 illustrated in FIG. 2, the contact surfaces 201 and 202 merge one into the other at an edge 212 below the step 207.

Figure 3:
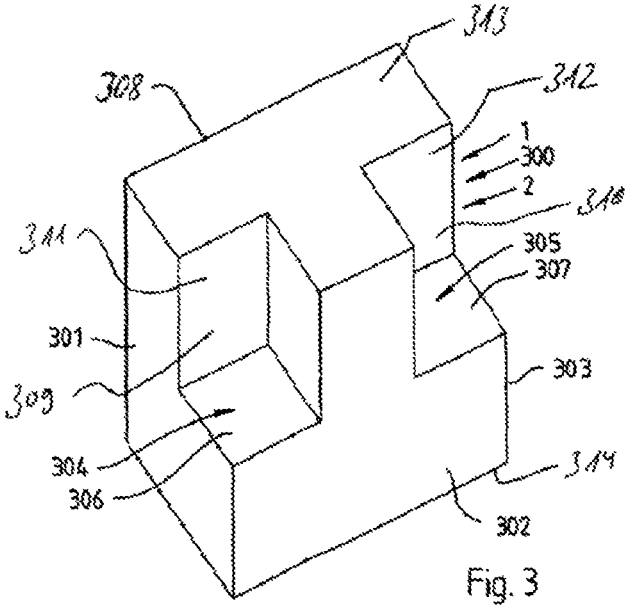

FIG. 3 illustrates a wall element 1 which is designed as a junction element 300. The junction element 300 has three contact surfaces 301, 302 and 303 which are approximately perpendicular in the room, wherein steps 304, 305 with supporting surfaces 306, 307 are formed between adjacent contact surfaces 301 and 302, and 302 and 303, which are directly adjacent to each other. The two contact surfaces 301 and 303 of the three contact surfaces 301, 302 and 303 are designed as congruent surfaces. The third contact surface 302 permits the fitting of a stepped element 100, as shown in FIG. 1, in two different positions, wherein the stepped element 100 is rotated in each case through 180° about the vertical axis HA100 thereof to change from the one position into the other position. The junction element 300 has three visible surfaces 308, 309 and 310, wherein the visible surfaces 309 and 310 are designed as visible subsurfaces 311 and 312 which each lie above the steps 304 and 305. The visible surfaces 308, 309 and 310 are connected to one another via a top surface 313. A bottom surface 314 is aligned parallel to the top surface 313.

FIG. 4 illustrates a wall element 1 which is designed as an intersection element 400. The intersection element 400 has four perpendicular contact surfaces 401, 402, 403 and 404. Said contact surfaces 401-404 are aligned in pairs parallel to one another, that is to say, the contact surfaces 401 and 403 are parallel to each other, and the contact surfaces 402 and 404 are parallel to each other. Two directly adjacent contact surfaces 401 and 404, and 402 and 403 together form a step 405 and 406, respectively. The intersection element 400 has four visible surfaces 407, 408, 409 and 410, wherein the visible surfaces 407 and 409 are designed as visible subsurfaces 410 and 411 which respectively lie above steps 412 and 413. The visible surfaces 407, 408, 409 and 410 are connected to one another via a top surface 414. A bottom surface 415 is aligned parallel to the top surface 414.

FIG. 5 illustrates a wall element 1 which is designed as a change-over element 500. The change-over element 500 has two perpendicular contact surfaces 501 and 502. Furthermore, the change-over element 500 has two visible surfaces 503 and 504 which comprise a respective step 505 and 506 with a respective supporting surface 507 and 508. The two contact surfaces 501 and 502 are aligned parallel to each other and are oriented in a mirror-rotated manner to each other with respect to a vertical mirror axis SA500. The change-over element 500 has two visible surfaces 509 and 510. The visible surfaces 509 and 510 are connected to each other via a top surface 511. A bottom surface 512 is aligned parallel to the top surface 511.

FIG. 6 illustrates, in a perspective exploded view, a partition system 2 which comprises three stepped elements 100 as wall element 1, a corner element 200, a junction element 300, an intersection element 400 and a change-over element 500. It is characteristic of the partition system 2 that all of the wall elements 1 join one another with congruent contact surfaces 101, 102, 201, 202, 301, 303, 401, 402, 403, 404, 501 and 502. By this means, when the wall elements 1, which are connected to one another in a rotationally secure and displacement secure manner in each case by means of two connecting means 4, 5—only illustrated schematically and by way of example—are pushed together, a continuous partition 3 having branches 6, 7 and 8 is produced, wherein the partition 3 makes it possible to subdivide a room 9 into cells I, II and III.

Figure 10:
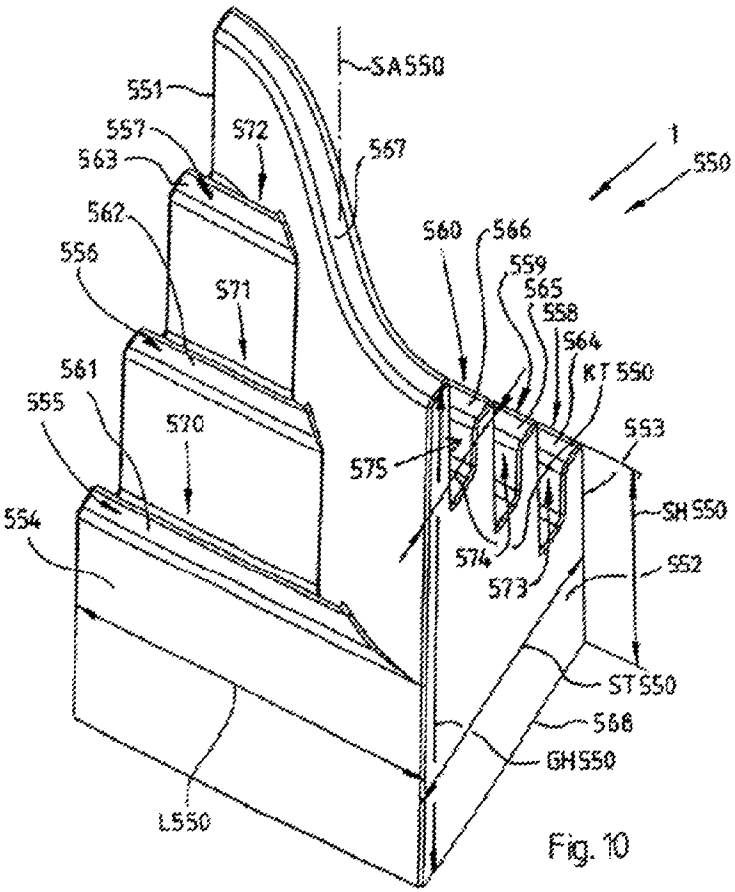
Figure 11:
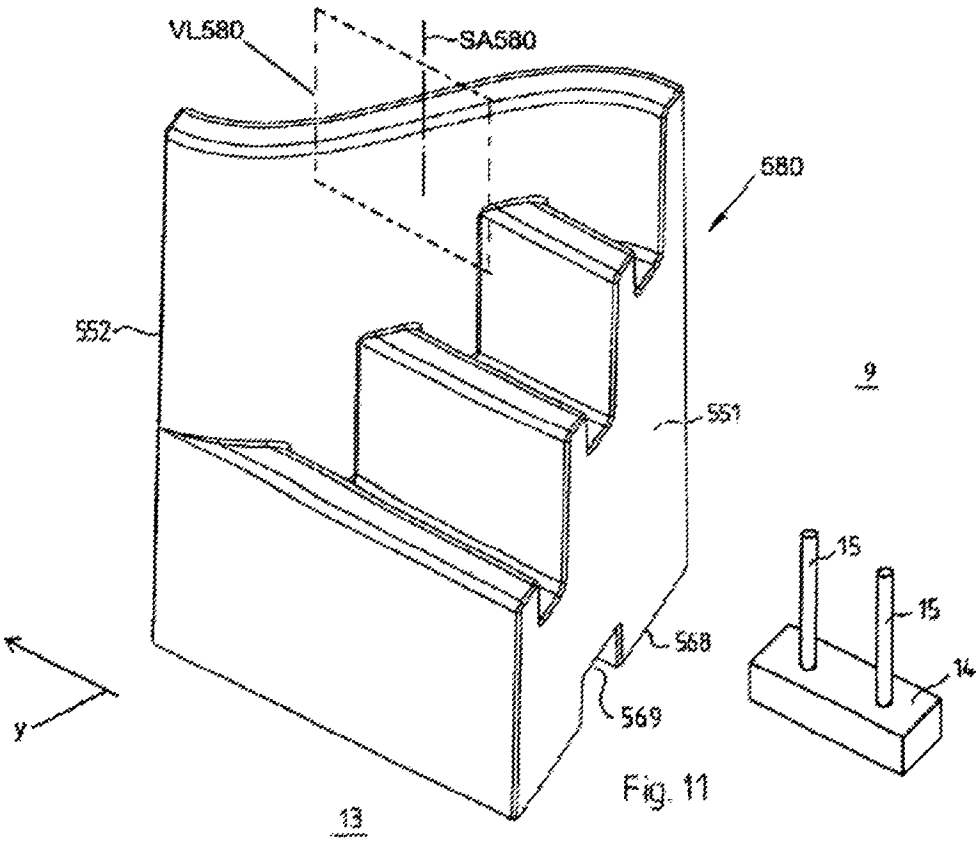
Figure 12A:
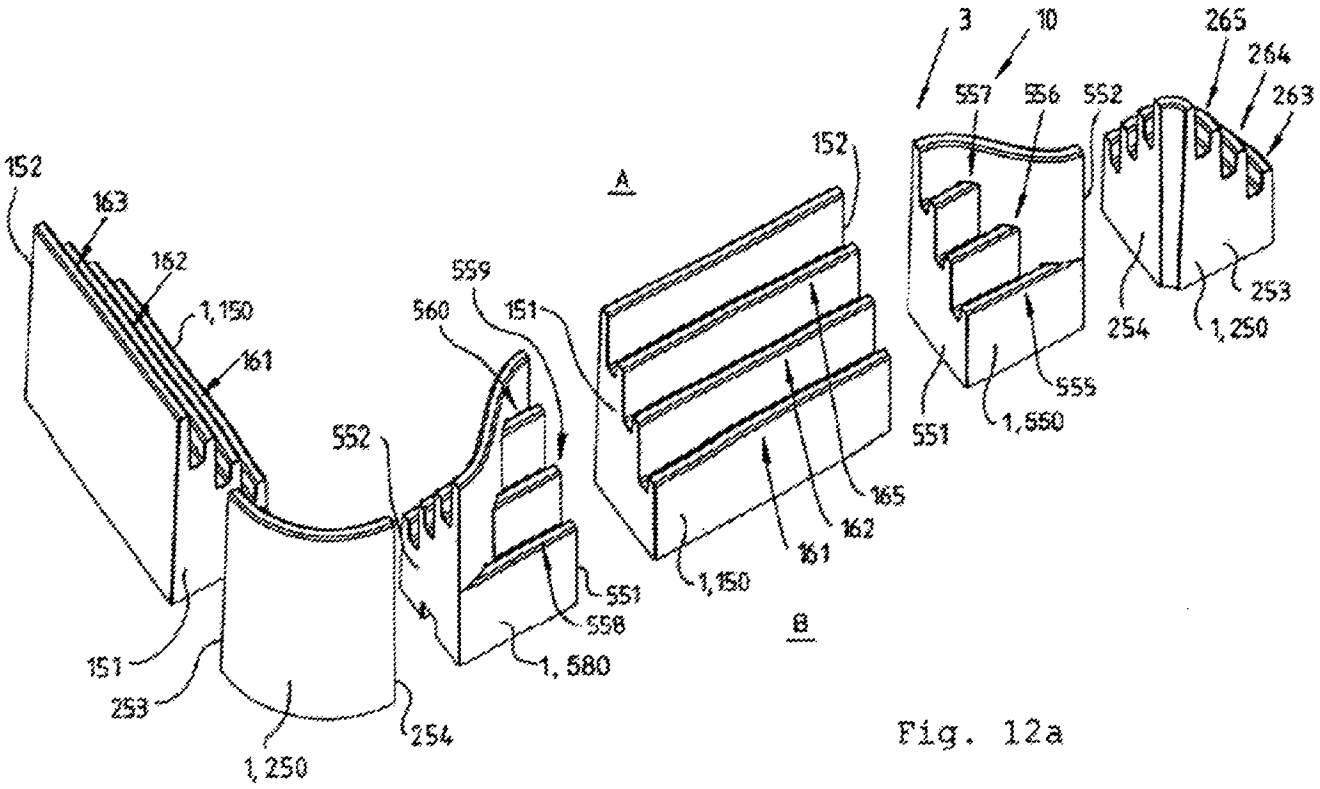
FIG. 12*a* shows a first partition 5 with an L-shaped profile, which partition is composed of wall elements of the second partition system.
Figure 12B:
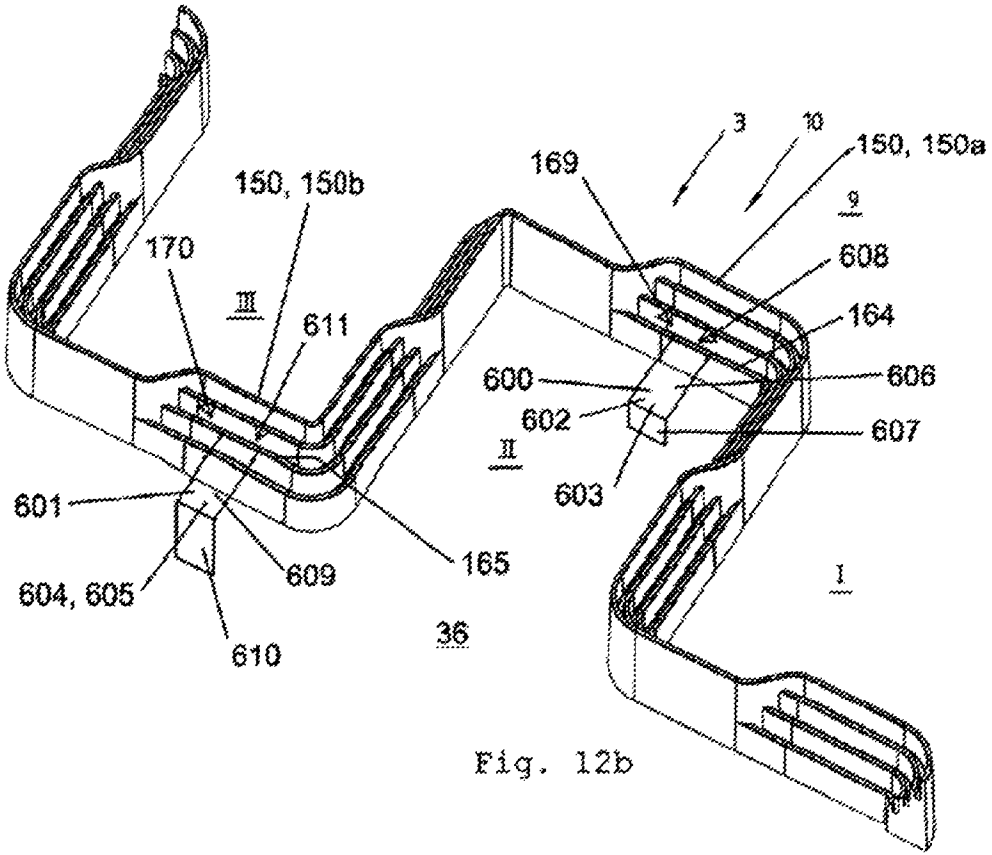
FIG. 12*b* shows a second partition with a snake-like profile, which partition is composed of wall elements of the second partition system.

FIGS. 7 to 11 and 19 to 22 show wall elements 1 of a second partition system 10 in a schematic, perspective view, and FIGS. 12*a* and 12*b* show a first partition 11 and a second partition 12, which are composed of wall elements 1 of the second partition system 10, in a schematic, perspective view.

Figure 7:
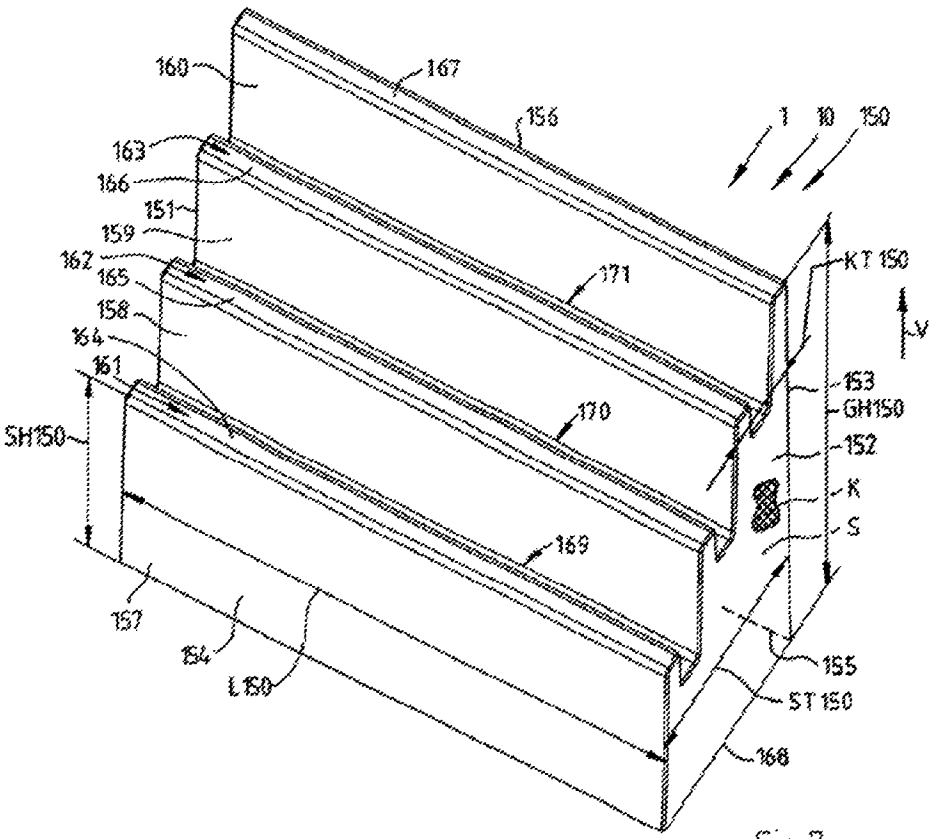
FIGS. 7 to 11 show wall elements of a second partition system.

The wall element 1, which is shown in FIG. 7, of the second partition system 10 is designed as a stepped element 150. The stepped element 150 has two contact surfaces 151 and 152 oriented approximately parallel to each other. Furthermore, the stepped element 150 has two visible surfaces 153 and 154 oriented approximately parallel to each other. In this case, the first visible surface 153 runs continuously from a lower edge 155 to an upper edge 156 of the stepped element 150. The second visible surface 154 is designed as an offset visible surface 154 and consists of four visible subsurfaces 157, 158, 159 and 160. The latter merge one into another via steps 161, 162 and 163 which form supporting surfaces 164, 165 and 166. The first visible surface 153 of the stepped element 160 and the upper visible subsurface 160 of the stepped element 150 are connected by a top surface 167. The latter runs parallel to a bottom surface 168 of the stepped element 150. The stepped element 150 has a length L150, an overall height GH150, a base height SH150, a base depth ST150 and a head depth KT150. The supporting surfaces 164, 165 and 166 have respective grooves 169, 170 and 171 which are open upward in the direction of a vertical V and extend over the entire length L150 of the stepped element 150 and are open toward the contact surfaces 151 and 152.

Figure 8:
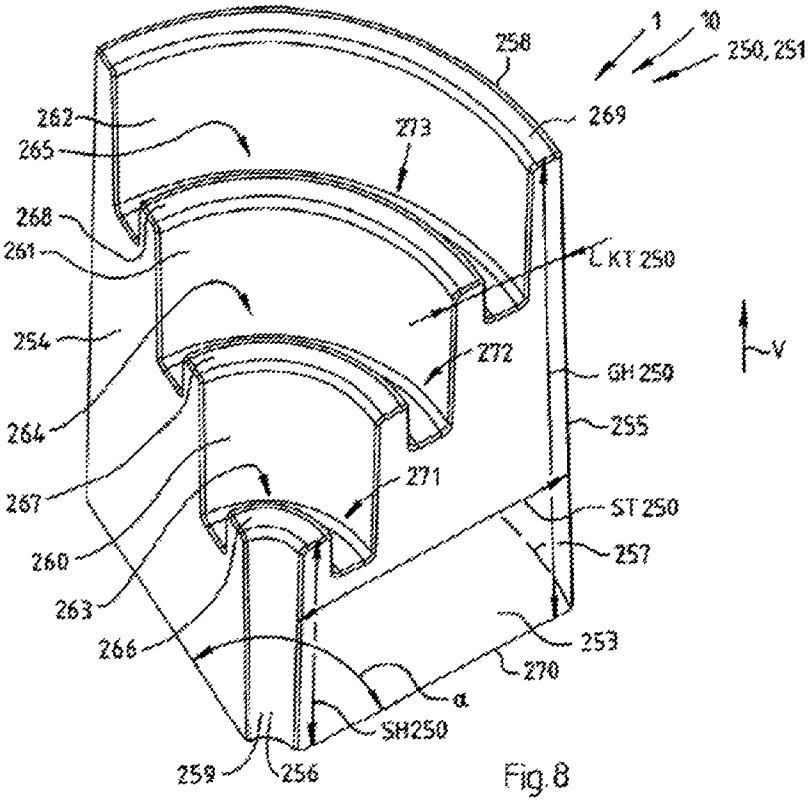
Figure 9:
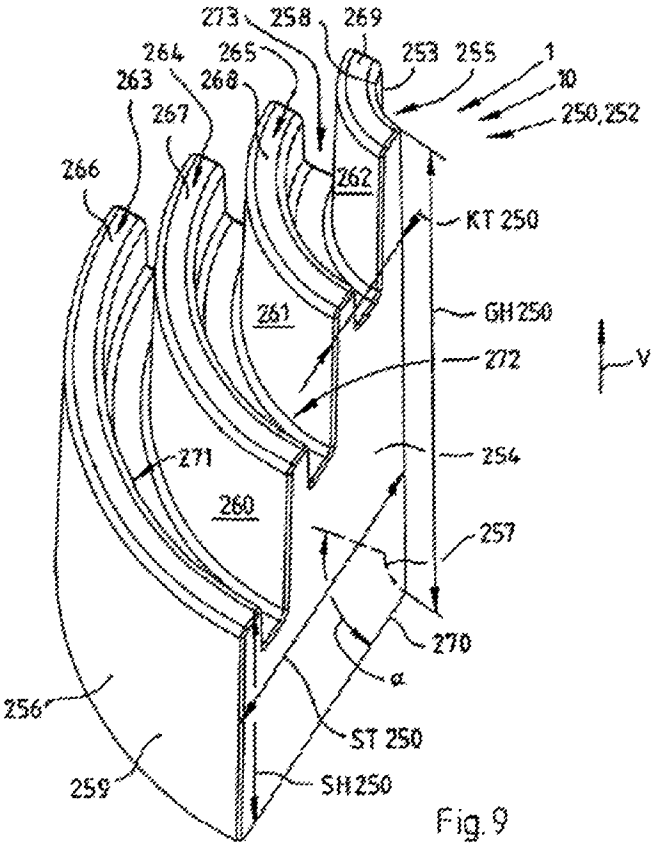

The wall elements 1, which are shown in FIGS. 8 and 9, of the second partition system 10 are designed as 20 corner element 250, wherein the corner element 250 which is shown in FIG. 8 is designed as an inner corner element 251 and the corner element 250 which is shown in FIG. 9 is designed as an outer corner element 252.

The inner corner element 251 and the outer corner element 252 have contact surfaces 253 and 254 oriented perpendicularly. Said contact surfaces are each at an angle $\alpha$ of 90° to each other. The inner corner element 251 and the outer corner element 252 furthermore have two visible surfaces 255 and 256. The first visible surface 255 is designed here as a convex visible surface 255 which runs from an arcuate lower edge 257 to an arcuate upper edge 258 of the inner corner element 251 or the outer corner element 252. In both corner element variants 250, the second visible surface 256 comprises four visible subsurfaces 259, 260, 261 and 262 and three steps 263, 264 and 265 with supporting surfaces 266, 267 and 268. The first visible surface 255 of the particular corner element 251 or 252 and the upper visible subsurface 262 of the particular corner element 251 or 252 are each connected by a top surface 269. The latter runs parallel to a bottom surface 270 of the particular corner element 251 and 252. The corner elements 251 and 252 each have an overall height GH250, a base height SH250, a base depth ST250 and a head depth KT250. The supporting surfaces 263, 264 and 265 each have arcuate grooves 271, 272 and 273 which are open upward in the direction of a vertical V and are open toward the contact surfaces 253 and 254.

FIG. 10 illustrates a wall element 1 which is designed as a change-over element 550. The change-over element 550 has two perpendicular contact surfaces 551 and 552. Furthermore, the change-over element 550 has two visible surfaces 553 and 554 which each comprise three steps 555, 556 and 557 or 558, 559 and 560 with supporting surfaces 561, 562 and 563 or 564, 565 and 566. The visible surfaces 553 and 554 merge one into another via a top surface 567, wherein the top surface 567 runs parallel to a bottom surface 568. The two contact surfaces 551 and 552 are aligned parallel to each other and are oriented in a mirror-rotated manner to each other with respect to a vertical mirror axis SA550. The change-over element 550 is constructed in an overall mirror-symmetrical manner with respect to the mirror axis SA550. The change-over element 550 has a length L550, an overall height GH550, a base height SH550, a base depth ST550 and a head depth KT550.

For what has been mentioned of the second partition system 10, the base height, as measured at the height 35 of the first step, is more than twice as large as the head depth, as measured at the height of the third step, wherein the head depth is in particular at least ¼ of the base depth.

FIG. 11 illustrates a variant embodiment of the change-over element shown in FIG. 10, wherein the illustration shows a change-over element 580 which arises through reflection of the change-over element 550 known from FIG. 10 on a vertical 5 longitudinal center plane VL580 running the mirror axis SA550. In this variant embodiment, a groove 569 which runs in the longitudinal direction y of the change-over element 580 and is open with respect to the contact surfaces 551 and 552 of the change-over element 580 and with respect to a floor 13 of a room 9 is made in a bottom surface 568. The partition system may include guide elements which are designed as rails 14, are matched in the dimensions thereof to the groove 569 and are connected, in particular screwed or adhesively bonded, to the floor 13 of the room 9 in order to keep the wall elements of the partition system in a predefined position. Provision is also in particular made here for the rails 14 to be designed as a cable duct and/or supply duct. Furthermore, provision is made for the rails 14 also to be designed as connecting means and for this purpose to have in particular pins 15 which can be inserted into bores in adjacent wall elements in order to fix said wall elements to one another or to stabilize said wall elements.

The supporting surfaces 561 to 566, which are shown in FIG. 10, of the steps 555 to 560 each have a groove 570 to 575. The grooves 570 to 575 are open upward and are each open with respect to the contact surface 551 or 552.

FIGS. 19 to 22 denote a height of the first step on each of the element types illustrated by a, a height of the second step by b, a height of the third step by c, and a height of a fourth step, which is in each case formed by the top surface, by d. The height of the first step is defined here as the distance between the bottom surface and the supporting surface of the first step. The height of the second step is defined here as the distance between the bottom surface and the supporting surface of the second step. The height of the third step is defined here as the distance between the bottom surface and the supporting surface of the third step. The height of the fourth step is defined here as the distance between the bottom surface and the supporting surface of the fourth step. In all of the element types, the widths which the element types on one of the contact surfaces below the first step, between the first and the second step, between the second and the third step and above the third step have are correspondingly denoted by e, f, g and h. The wall elements, which are shown in FIGS. 7 to 11, of the second partition system are correspondingly dimensioned, wherein the following applies with regard to the dimensions indicated in said figures: SH150=SH250=SH550=a, GH150=GH250=GH550=d, ST150=ST250=ST550=e, and KT150=KT250=KT550=g.

FIG. 12*a* illustrates, in a perspective exploded view, a partition 3 which is constructed from the partition system 10 and, as wall elements 1, comprises two stepped elements 150, two corner elements 250 and two change-over elements 550, 580. It is characteristic of the partition system 10 that all of the wall elements 1 join one another with congruent contact surfaces 151, 152, 253, 254, 551, 552. By this means, when the wall elements 1, which are connected to one another in a rotationally secure and displacement secure manner in each case by connecting means (not illustrated), are pushed together, a continuous partition 3 is produced. By means of the change-over elements 550, 580, the steps 161, 162, 163, 263, 264, 265, 555 to 560 can be changed over from a partition side A to a partition side B.

FIG. 12*b* illustrates, in a perspective view, a further partition 3 which is constructed from the partition system 10. It is shown here how a room 9 is subdivided into three cells I, II, III by a partition 3 running in a snake-like manner. The partition system also comprises furniture elements 600, 601 which are illustrated here by way of example and schematically in the form of a transparent seat element 602, which is designed as a bench 603, and in the form of a transparent table element 604, which is designed as a desk 605.

The seat element 602 comprises a seat panel 606, a first side member 607 reaching to a floor 36 and a second side member 608 which enters the groove 169 of the first stepped element 150, 150*a*. The seat element 602 rests by means of the seat panel 606 on the supporting surface 164 of the stepped element 150, 150*a*. The seat panel 606 runs parallel to the floor at a height of approximately 45 cm to 55 cm.

The table element 604 comprises a table top 609, a first side member 610 reaching onto the floor 36 and a second side member 611 entering the groove 170 of the second stepped element 150, 150*b*. The table element 604 rests by means of the table top 609 on the supporting surface 165 of the stepped element 150, 150*b*. The table top 609 runs parallel to the floor 36 at a height of approximately 65 cm to 72 cm.

For the first partition system 2, GH100=GH200 and SH100=SH200 and ST100=ST200 and KT100=KT200, wherein in particular GH100>100 cm, and furthermore in particular 50 cm>ST100>20 cm, and furthermore in 35 particular SH100>40 cm or SH100>60 cm.

For the second partition system 10, GH150=GH250=GH550 and SH150=SH250=SH550 and ST150=ST250=ST550 and KT150=KT250=KT550, where in particular GH150>100 cm, wherein furthermore in particular 50 cm>ST150>20 cm, and furthermore in particular SH150>40 cm or SH150>60 cm.

The wall elements 1 of the first partition 5 system 2 and of the second partition system 10 have a core K which determines the geometrical shape of the particular wall element 1—see FIGS. 1 and 7. The core K is coated or covered with a layer or shell S.

Figure 13:
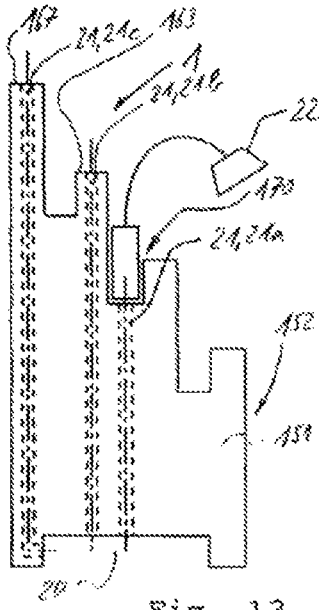
FIG. 13 shows a schematic illustration of a wall element with cable ducts.

FIG. 13 illustrates the wall element 1, which is shown in FIG. 7, schematically in a side view of the contact surface 151, wherein, in the configuration shown in FIG. 13, the wall element 1*a* first cable duct 20 which is open toward a bottom surface 168 and toward the contact surfaces 151 and 152. Furthermore, FIG. 13 shows three second cable ducts 21 or 21*a*, 21*b* and 21*c*, wherein one or more of the second cable ducts 21*a*-21*c*, depending on requirements, are formed on the wall element 1. The cable duct 21*a* runs from a groove 170 into the first cable duct 20. The cable duct 21*b* runs from a step 163 into the first cable duct 20. The cable duct 21*c* runs from a top surface 167 into the first cable duct 20. By means of the cable duct 21*a*, it is, for example, possible to supply a lamp 22, which is positioned in the groove 170, with current from the first cable duct 20.

Figure 14:
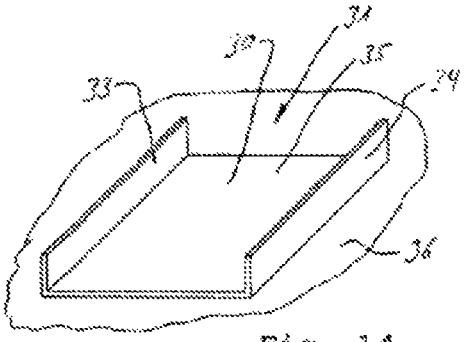
FIG. 14 shows a perspective view of a guide element.

FIG. 14 shows, in a perspective view, a guide element 30 of a floor rail system 31. The guide element 30 comprises a base plate 32 and two webs 33 and 34 formed on the base plate 32, and forms a U profile 35. The guide element 30 is fastened on a floor 36, wherein the fastening takes place, for example, by means of adhesive bonding or screwing. When the guide element is fitted, the webs 33 and 34 protrude vertically upward from the floor 36.

Figure 15:
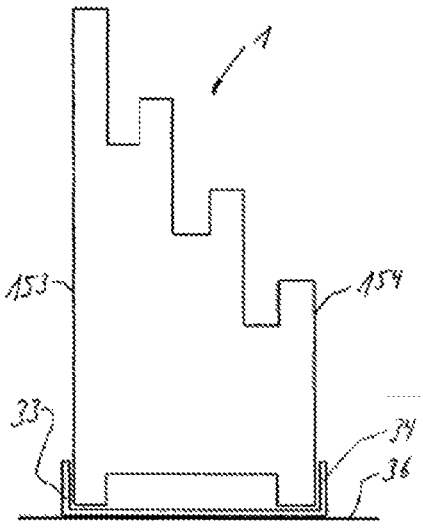
FIG. 15 shows a schematic illustration of a wall element inserted into the guide element shown in FIG. 14.

FIG. 15 shows schematically a wall element 1 which is inserted into the guide element 30 known from FIG. 14. The guide element 30 forms a guide rail for the wall element 1, in which the latter is held laterally by the webs 33 and 34, wherein the webs 33 and 34 bear against the visible surfaces 153 and 154.

Figure 16:
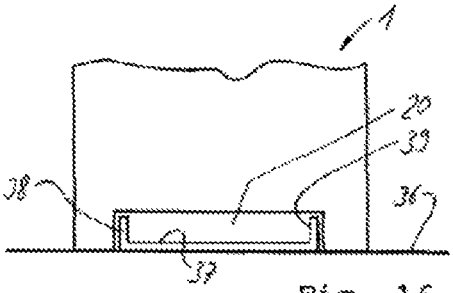
FIG. 16 shows a further guide element with a wall element placed thereon, wherein the wall element has a first cable duct.

FIG. 16 shows a further guide element 37 which is dimensioned such that it can be engaged over by a wall element 1 which is formed comparably to the wall element shown in FIG. 13, with a first cable duct 20. A guide element 37 which is matched to the first cable duct 20 affords the advantage that the cables which are provided for the first cable duct can already be laid therein in advance.

Figure 17:
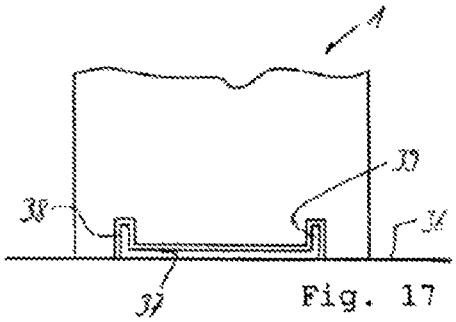
FIG. 17 shows the guide element shown in FIG. 16 and a wall element placed thereon, wherein the wall element does not have a first cable duct.

Finally, FIG. 17 illustrates an alternative use of the guide element 37 shown in FIG. 16. Said guide element may also be used as a claw onto which a wall element 1 is pressed, wherein webs 38, 39 of the guide element 37 cut into the wall element when the latter is pressed thereon.

In principle, it should be noted with reference to FIGS. 14 to 17 that the floor rail system, which is part of the partition system, provides the use of at least one guide element per wall element and in particular also a continuous arrangement of floor rail elements is provided. In this case, the floor rail elements are, of course, adapted to the specific geometry of the different wall elements and have in particular also an arcuate profile or are in particular designed as T-shaped or cross-shaped guide elements, as seen in top view.

Figure 18:
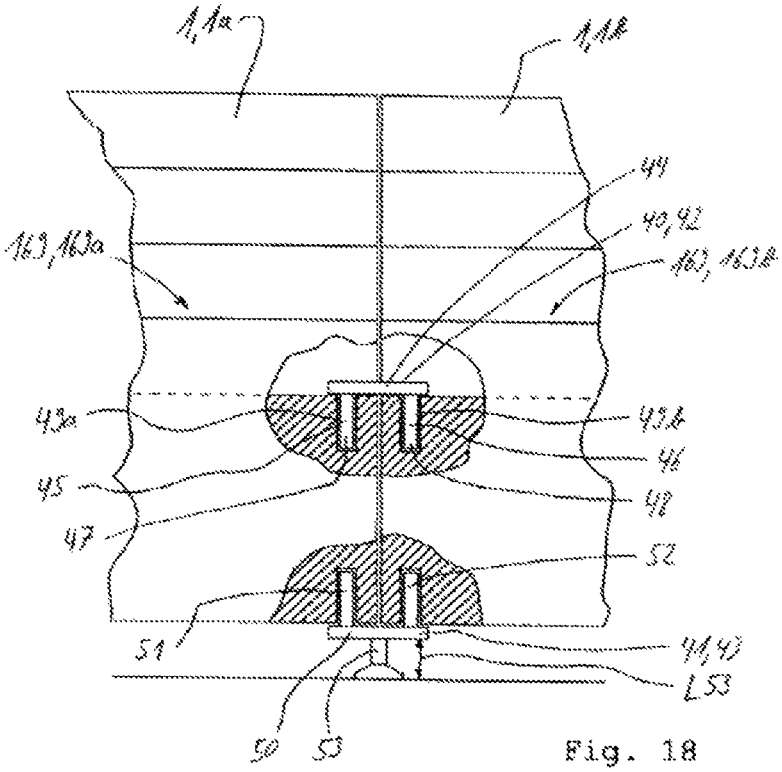
FIG. 18 shows a schematic view of two wall elements connected by connecting elements.

FIG. 18 shows a partially cut open schematic view of two adjacent wall elements 1 or 1*a* and 1*b* which are connected by two connecting means 40, 41 designed as clamps 42, 43. The upper clamp 42 is positioned in grooves 169 or 169*a* and 169*b* of the two wall elements 1*a* and 1*b*. The upper clamp 42 comprises a support 44 and two pins 45 and 46 which run parallel to each other and are connected to the support. The pins 45 and 46 are plugged by free ends 47 and 48 into bores 49*a* and 49*b* formed in the grooves 169*a* and 169*b* of the wall elements 1*a* and 1*b*. By this means, the wall elements 1*a* and 1*b* are held in the illustrated position in which said wall elements bear against each other. The clamp 42 can be used for connecting two adjacent wall elements wherever bores matched to the clamp 42 are present on the two wall elements 1*a* and 1*b*. In contrast to the clamp 42, the clamp 43 also comprises an adjustable foot 53 in addition to a support 50 and two pins 51 and 52. The adjustable foot 53 is arranged centrally between the two pins 51 and 52 in order to be able optimally to support the two wall elements 1*a* and 1*b*. A length L53 of the adjustable foot 53 can be changed, for example by means of a thread (not illustrated), and therefore a distance between the support 50 and a floor 36 can be changed.

Figure 19:
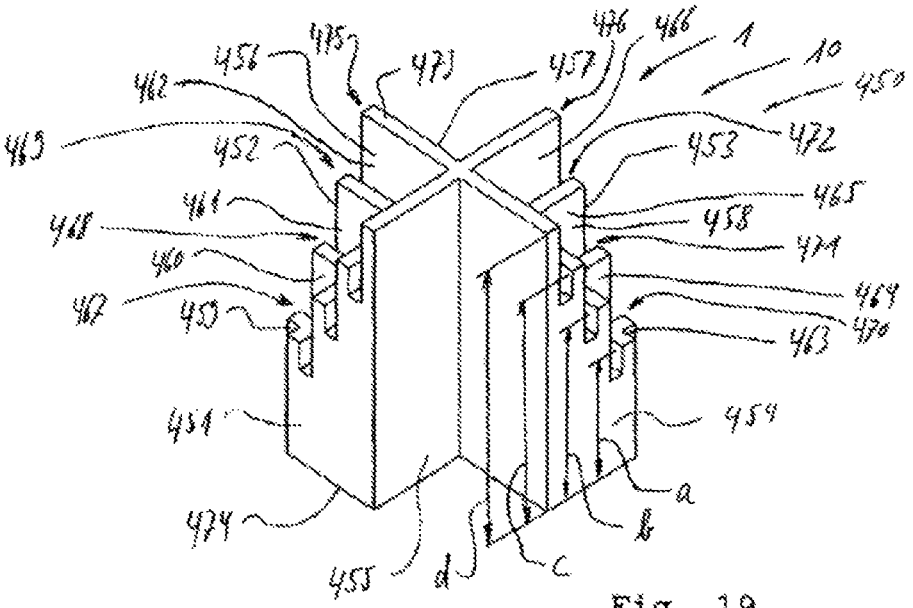
FIGS. 19, 20 show a perspective view and top view of an intersection element.

FIG. 19 shows a further wall element 1 of the second partition system 10, which wall element is designed as an intersection element 450. The intersection element 450 has four contact surfaces 451 to 454 and four visible surfaces 455 to 458. The visible surfaces 456 and 458 are each formed here by four visible subsurfaces 459 to 462 and 463 to 466 which merge into one another in each case via three steps 467, 468, 469 and 470, 471, 472. The visible surfaces 455 and 457 and the upper visible subsurfaces 462 and 466 are connected by a top surface 473 which runs parallel to a bottom surface 474. The top surface 473 forms a respective fourth step 475 and 476 with respect to the upper visible subsurfaces 462 and 466.

Figure 20:
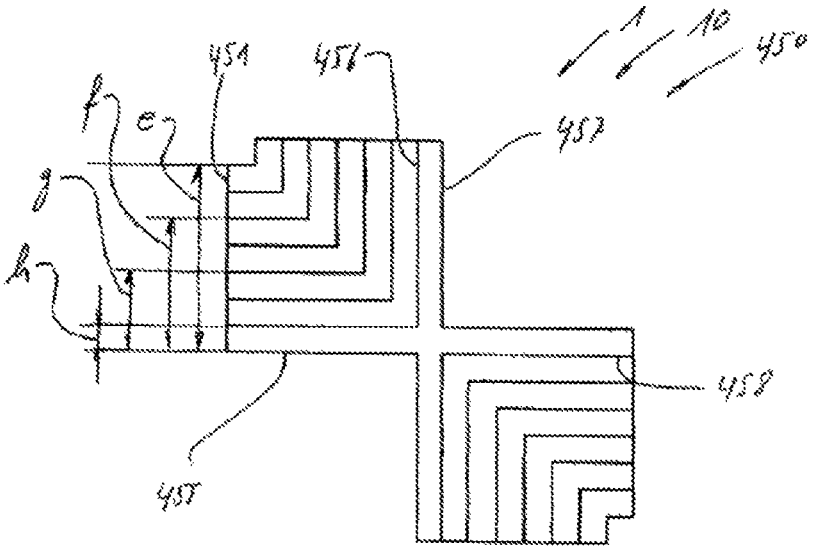

In the top view, which is shown in FIG. 20, of the intersection element 450, it can be seen that the visible surfaces 455 to 458 are all of angled design. In the region of the contact surface 451, the intersection element 450 has a width e below the first step, a width f between the first and the second step, a width g between the second and the third step, and a width h above the third step. The heights a, b, c and d of the first to fourth steps 467, 468, 469, 475 and 470, 471, 472 and 476 are shown in FIG. 19.

Figure 21:
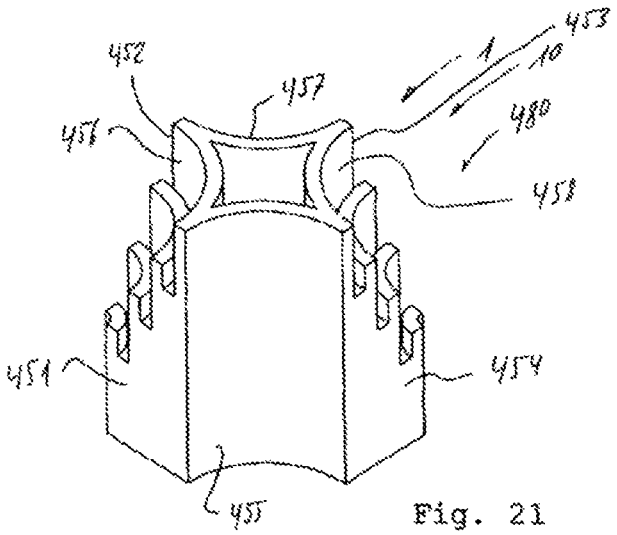
FIGS. 21, 22 show a perspective view and top view of a further intersection element.
Figure 22:
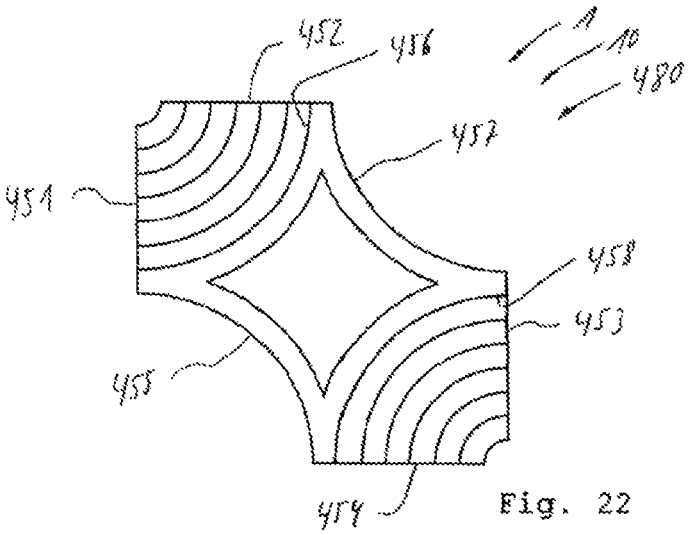

FIGS. 21 and 22 show a further wall element 1 of the second partition system 10, which wall element is designed as a further intersection element 480. With regard to the intersection element 480, reference is made to the description for FIGS. 19 and 20. In contrast to the intersection element shown there, visible surfaces 455 to 458 are not of angled design here but rather are of rounded design in an arcuate manner. Contact surfaces 451 to 454 are formed in a planar and congruent manner with the contact surfaces of the intersection element shown in FIGS. 19 and 20. Accordingly, the intersection element 480 also has the same dimensions with regard to widths and heights.

The invention is not restricted to exemplary embodiments illustrated or described. On the contrary, it comprises developments of the invention within the scope of the patent claims. The adjacent wall elements may be fully in contact by means of the contact surfaces thereof. This substantially increases the stability of the partition, since adjacent wall elements are supported against one another and stabilized via the friction between the contact surfaces.

LIST OF DESIGNATIONS

1 wall element
1*a*, 1*b* wall element
2 partition system
3 partition
4, 5 connecting means
6, 7, 8 branch
9 room
10 partition system
11 first partition
12 second partition
13 floor
14 rail
15 pin
20 first cable duct
21, 21*a*-21*c* second cable duct
22 lamp
30 guide element
31 floor rail system
32 base plate of 30
33, 34 web of 30
35 U profile
36 floor
37 guide element
38, 39 web of 37
40, 41 connecting means
42, 43 clamps
44 support of 42
45, 46 pin of 42
47, 48 free end of 45 and 46
49*a*, 49*b* bore in 1*a* and 1*b*
50 support of 43
51, 52 pin of 43
53 adjustable foot of
A partition side
B partition side
K core
S layer or shell of K
V vertical
y longitudinal direction
a-d height of 1
e-h width of 1
α angle
I-III cell
100 stepped element
101, 102 contact surface
103, 104 visible surface
105 lower edge
106 upper edge
107, 108 visible subsurface
109 step
110 supporting surface
111 top surface

112 bottom surface
113 groove
L100 length
GH100 overall height
SH100 base height
ST100 base depth
KT100 head depth
HA100 vertical axis
150 stepped element
151, 152 contact surface
153, 154 visible surface
155 lower edge
156 upper edge
157-160 visible subsurface
161-163 steps
164-166 supporting surface
167 top surface
168 bottom surface
169-171 groove
169*a* groove of 1*a*
169*b* groove of 1*b*
L150 length
GH150 overall height
SH150 base height
ST150 base depth
KT150 head depth
200 corner element
201, 202 contact surface
203, 204 visible surface
205 L-shaped lower edge
206 L-shaped upper edge
207 step
208 supporting surface
209 visible subsurface
210 top surface
211 bottom surface
212 edge
GH200 overall height
SH200 base height
ST200 base depth
KT200 head depth
250 corner elements
251 inner corner element
252 outer corner element
253, 254 contact surface
255, 256 visible surface
257 lower edge
258 upper edge
259-262 visible subsurface
263-265 steps
266-268 supporting surface
269 top surface
270 bottom surface
271-273 groove
GH250 overall height
SH250 base height
ST250 base depth
KT250 head depth
300 junction element
301-303 contact surface
304, 305 steps
306, 307 supporting surface
308-310 visible surface
311, 312 visible subsurface
313 top surface
314 bottom surface 314
400 intersection element
401-404 contact surface
405, 406 step
407-410 visible surface
410, 411 visible subsurface
412, 413 step
414 top surface
415 bottom surface
450 intersection element
451-454 contact surface
455-458 visible surface
459-462 visible subsurface
463-466 visible subsurface
467-469 step
470-472 step
473 top surface
474 bottom surface
475, 476 step
480 intersection element
500 change-over element
501, 502 contact surface
503, 504 visible surface
505, 506 step
507, 508 supporting surface
509, 510 visible surfaces
511 top surface
512 bottom surface
SA500 mirror axis
550 change-over element
551, 552 contact surface
553, 554 visible surface
555-560 steps
561-566 supporting surface
567 top surface
568 bottom surface
569 groove
570-575 groove
580 change-over element
SA550 mirror axis
L550 length
GH550 overall height
SH550 base height
ST550 base depth
KT550 head depth
VL580 vertical longitudinal center plane
600, 601 furniture element
602 seat element
603 bench
604 table element
605 desk
606 seat panel of 603
607 first side member of 603
608 second side member of 603
609 table top of 604
610 first side member of 604
611 second side member of 604

The invention claimed is:

1. A partition comprising:

a wall element having a curved top surface, a rectilinear bottom surface, a first contact surface, a second contact surface spaced from the first contact surface, a first visible side, and a second visible side, wherein the first visible side includes a first curved portion relative to a vertical axis and a second curved portion relative to the vertical axis wherein the rectilinear bottom surface extends between the first contact surface, the second contact surface, the first visible side, and the second visible side.

2. The partition of claim 1, wherein the first curved portion includes a concave curve and the second curved portion includes a convex curve.

3. The partition of claim 1, wherein the second visible side includes a convex curved portion and a concave curved portion.

4. The partition of claim 1, wherein the first contact surface is opposite and parallel to the second contact surface.

5. The partition of claim 4, wherein the first contact surface is mirrored to the second contact surface.

6. The partition of claim 1, wherein the first visible side includes a first step having a first supporting surface and the second visible side includes a second step having a second supporting surface.

7. The partition of claim 6, wherein an upward facing first groove is positioned adjacent the first step and an upward facing second groove is positioned adjacent the second step.

8. The partition of claim 1, wherein the wall element has a mirror-symmetric configuration relative to a mirror axis.

9. The partition of claim 1, wherein the wall element includes a groove in the bottom surface.

10. A partition comprising:

a wall element having a first contact surface, a second contact surface spaced from the first contact surface, a first visible side having a first curved portion, and a second visible side having a second curved portion, wherein the wall element has a mirror-symmetric configuration relative to a mirror axis wherein the first visible side includes a first step having a first supporting surface and the second visible side includes a second step having a second supporting surface.

11. The partition of claim 10, wherein the first curved portion includes a first concave curve and a first convex curve and the second curved portion includes a second concave curve and a second convex curve.

12. The partition of claim 11, wherein the first visible side includes a first step extending from the first concave curve and a second step extending from the first convex curve.

13. The partition of claim 12, wherein an upward facing first groove is positioned adjacent the first step and an upward facing second groove is positioned adjacent the second step.

14. The partition of claim 10, wherein the first visible side includes a vertical, planar surface.

15. The partition of claim 10, wherein the first contact surface is opposite and parallel to the second contact surface.

16. A partition comprising:

a first wall element having a curved top surface, a rectilinear bottom surface, a first contact surface, a second contact surface spaced from the first contact surface, a first visible side having a first curved portion, and a second visible side having a second curved portion, wherein the first curved portion includes a first concave curve and a first convex curve and the second curved portion includes a second concave curve and a second convex curve;

and a second wall element positioned adjacent the first contact surface.

17. The partition of claim 16, wherein the first visible side includes a first step having a first supporting surface and the second visible side includes a second step having a second supporting surface.

18. The partition of claim 16, wherein the first wall element includes a bottom having a groove and a guide element is received in the groove.

19. The partition of claim 18, wherein the guide element is connectable to a surface.

20. The partition of claim 18, wherein the guide element includes a duct.

21. The partition of claim 18, wherein the guide element connects the first wall element and the second wall element.

22. The partition of claim 21, wherein the guide element includes a first pin engaging the first wall element and a second pin engaging a second wall element.

* * * * *